US005778282A

United States Patent [19]

Nagashima

[11] Patent Number: 5,778,282

[45] Date of Patent: Jul. 7, 1998

[54] DEVELOPER SUPPLYING CONTAINER, DEVELOPING DEVICE HAVING SAME AND PROCESS CARTRIDGE

[75] Inventor: Toshiaki Nagashima, Kawasaki, Japan

[73] Assignee: Canon Kabushiki Kaisha, Tokyo, Japan

[21] Appl. No.: 856,012

[22] Filed: May 14, 1997

Related U.S. Application Data

[63] Continuation of Ser. No. 34,466, Mar. 19, 1993, abandoned.

[30] Foreign Application Priority Data

Mar. 23, 1992 [JP] Japan ..... 4-064842

[51] Int. Cl.[6] ..... G03G 15/08

[52] U.S. Cl. ..... 399/106; 399/102

[58] Field of Search ..... 399/98, 102, 103, 399/105, 106; 222/DIG. 1; 141/363, 364, 368, 369

[56] References Cited

U.S. PATENT DOCUMENTS

| | | | |
|---|---|---|---|
| 4,062,385 | 12/1977 | Katsusha et al. | 141/89 |
| 4,491,161 | 1/1985 | Tamura et al. | 141/364 |
| 4,614,286 | 9/1986 | Yamaguchi et al. | 222/DIG. 1 X |
| 4,627,476 | 12/1986 | Wilcke | 141/364 |
| 4,799,608 | 1/1989 | Oka | 222/DIG. 1 X |
| 4,873,549 | 10/1989 | Tada et al. | 355/206 |
| 4,895,104 | 1/1990 | Yoshino et al. | 222/DIG. 1 X |
| 4,930,684 | 6/1990 | Patterson | 222/DIG. 1 X |
| 4,931,838 | 6/1990 | Ban et al. | 355/260 |
| 5,027,156 | 6/1991 | Kobayashi | 355/245 |
| 5,030,998 | 7/1991 | Shibata et al. | 355/260 |
| 5,080,745 | 1/1992 | Paull | 222/DIG. 1 X |
| 5,101,871 | 4/1992 | Susumu | 141/364 |
| 5,153,650 | 10/1992 | Maeshina | 355/260 |
| 5,194,900 | 3/1993 | Hagihara et al. | 355/260 |
| 5,206,619 | 4/1993 | Kita | 355/260 |
| 5,235,390 | 8/1993 | Ishikawa | 355/260 |

FOREIGN PATENT DOCUMENTS

| | | |
|---|---|---|
| 0 112278 | 6/1984 | European Pat. Off. . |
| 2304106 | 8/1976 | France . |
| 59-13262 | 1/1984 | Japan . |
| 1315779 | 12/1989 | Japan . |

*Primary Examiner*—Sandra L. Brase
*Attorney, Agent, or Firm*—Fitzpatrick, Cella, Harper & Scinto

[57] ABSTRACT

A guide surface for engaging by a flexible film member closing a developer discharge opening of a developer supplying container is disposed at a downstream side of an elastic seal member against which the film is slidingly contacted when the film is pulled out, whereby the film is bent convexly against the elastic seal member.

58 Claims, 5 Drawing Sheets

DEVELOPER SUPPLYING CONTAINER, DEVELOPING DEVICE HAVING SAME AND PROCESS CARTRIDGE

This application is a continuation of application Ser. No. 08/034,466, filed Mar. 19, 1993, now abandoned.

BACKGROUND OF THE INVENTION

1. Field of the Invention

The present invention relates to a developer supplying container for supplying developer used for developing an electrostatic latent image, a developing device having such a developer supplying container, and a process cartridge having a developing device comprising such developer supplying container and removably mountable within an image forming apparatus.

2. Related Background Art

It is well known to provide a technique wherein, in a developer supplying container having an opening initially closed by a flexible film, the opening is opened by pulling out the flexible film and developer is supplied, through the opening, from the developer supplying container to a developing device having a developer carrying or bearing member. In such a technique, at an outlet portion through which the film is pulled out, a compressible elastic seal member is disposed to be engaged by the film, thereby sealing the clearance between the film and the outlet portion to prevent the developer from leaking out of the container or to remove the developer adhered to the film.

However, in pulling out the film, if the film is pulled in a direction such that excessive pressure acts on the elastic seal member, it will be difficult to pull the film due to the greater load on the film or the film may be torn to cause the leakage of the developer through the outlet portion.

SUMMARY OF THE INVENTION

An object of the present invention is to reduce a load acting on an elastic seal member disposed at an outlet portion through which a flexible film member initially closing a developer discharge opening of a developer supplying container is pulled out, when the flexible film member is pulled out through the outlet portion.

Another object of the present invention is to prevent the flexible film member from tearing when the film member is being pulled out.

A further object of the present invention is to prevent the increase in a pulling load acting on the flexible film member when it is being pulled out.

According to a preferred aspect of the present invention, an opening of a developer supplying container is closed by a flexible film member. The flexible film member has a first surface, a second surface, which is opposed to the first surface, and a free end portion. The flexible film member is pulled out from an outlet portion of the container by pulling the free end portion of the film member, thereby opening the opening. At the outlet portion, there is disposed an elastic seal member against which the first surface of the film member is slid.

A moving path through which the flexible film member is moved comprises a first path portion disposed at an upstream side of-the elastic seal member, a second path portion contiguous to the first path portion, and a third path portion contiguous to the second path portion and disposed at a downstream side of the elastic seal member. The flexible film member is slidingly contacted with the elastic seal member in the second path portion.

In the third path portion, there is arranged a film guide surface with which the first surface of the flexible film member is contacted. The film guide surface is contacted with the first surface of the flexible film member at a position offset from an extension line of the first path portion toward a direction directing from the first surface to the second surface of the flexible film member, thereby regulating the moving direction of the flexible film member in the second path portion.

With this arrangement, since an increase in an compressed amount of the elastic seal member can be prevented, it is possible to reduce the load acting on the elastic seal member, to prevent the elastic seal member from being damaged and to prevent a pulling force for the flexible film member from increasing.

Other objects and features of the present invention will be apparent from the following description.

DESCRIPTION OF THE PREFERRED EMBODIMENTS

First of all, a developer supplying container, developing device, and a process cartridge according to a preferred embodiment of the present invention will be explained.

Figure 2:
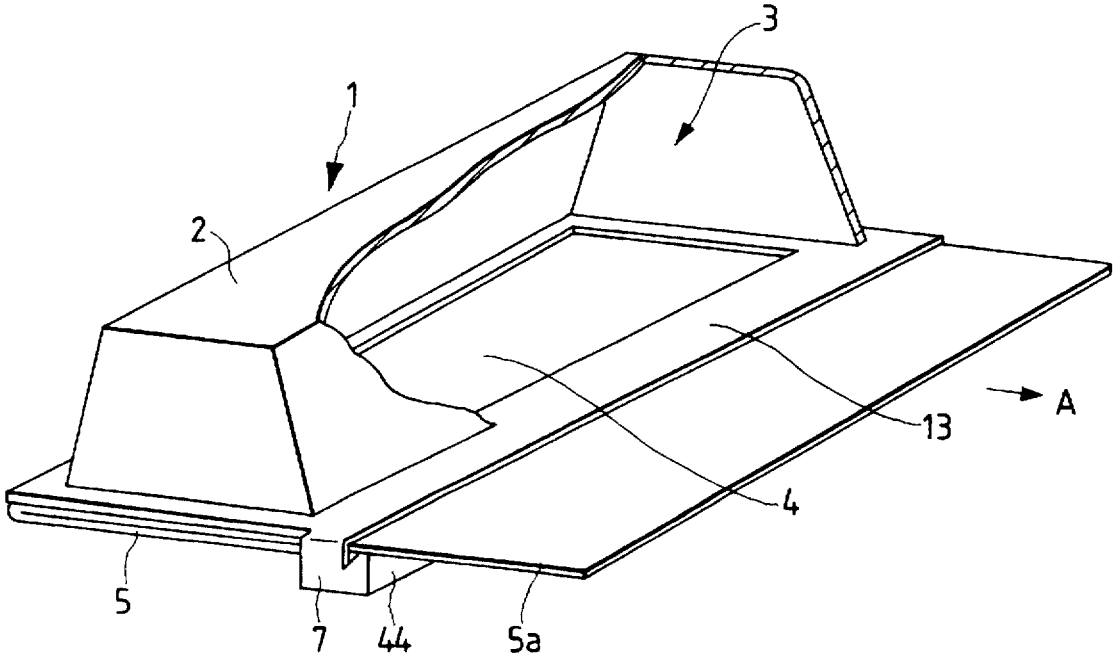
FIG. 2 is a perspective view, partially in section, of the developer supplying container.
Figure 3:
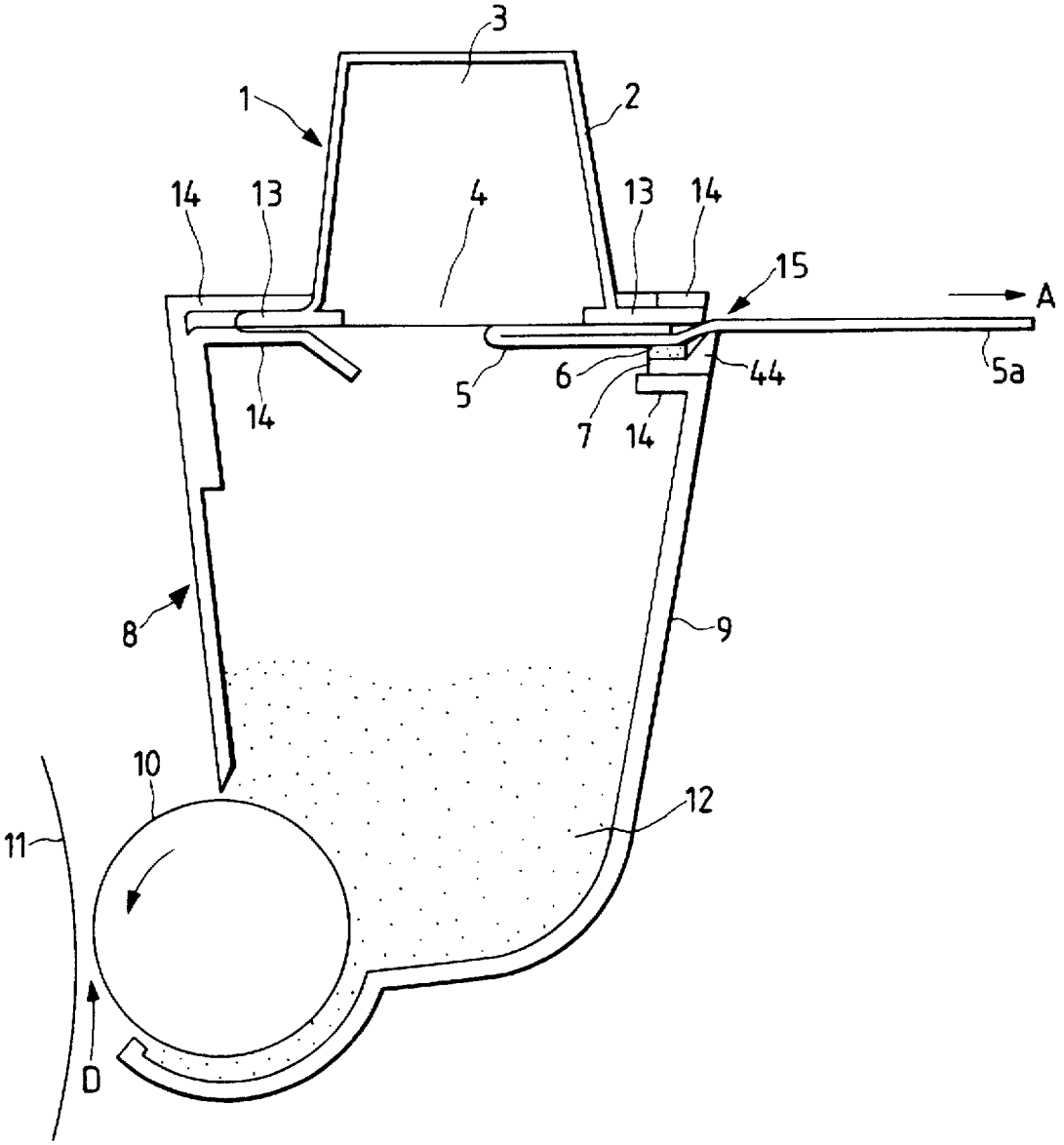
FIG. 3 is a sectional view of a developing device on which the developer supplying container of FIG. 2 is mounted.

In FIG. 2, a developer supplying container 1 which can removably be mounted on a developing device shown in FIG. 3, comprises a container body 2 defining a containing chamber 3 for containing and storing developer, and a flange portion 13 integrally formed with the container body 2 and having a developer discharge opening 4. The discharge opening 4 is initially closed by a flexible film 5 made of synthetic resin, such as polyethylene or the like. That is to say, the film 5 is peelably adhered to an outer surface of the flange portion 13 around the discharge opening 4 by a heat-seal or the like.

The film 5 has a first portion adhered to the flange portion 13, and a second portion folded on the first portion at an angle of about 180°. The film 5 can be peeled from the flange portion 13 to open the discharge opening 4 when an operator pulls a free end portion 5*a* of the folded portion (second portion) of the film in a direction shown by the arrow A.

Figure 1:
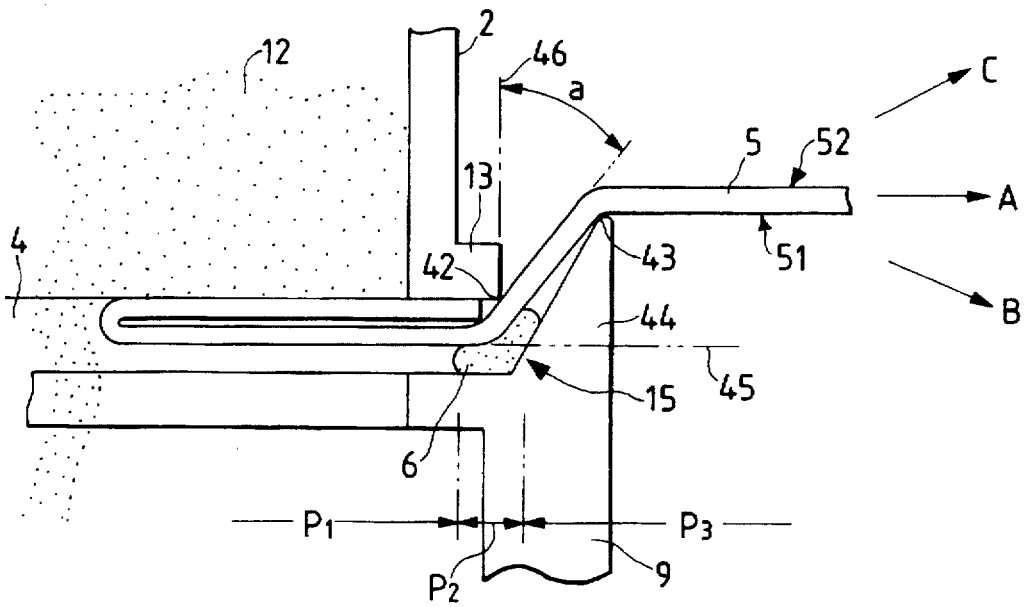
FIG. 1 is a sectional view of a main portion of a developer supplying container according to a preferred embodiment of the present invention.

A holder portion 7 is integrally formed with the flange portion 13, and a compressible and restorable elastic seal member (sponge elastomer, such as rubber or felt) 6 is supported by the holder portion 7 (see FIGS. 1 and 3).

The elastic seal member 6 is elastically abutted against the film 5 at an outlet portion for the film 5. When the film 5 is being pulled out, a surface (first surface) of the first portion of the film 5 with which the developer in the container body 2 was contacted is slid on the elastic seal member 6, so that the developer adhered. to the first surface of the film 5 is removed or scraped by the elastic seal member 6. Accordingly, since no developer is adhered to the firm surface pulled out from the container 1, it is possible to prevent the operator's hand or clothing from being smudged by the developer.

The developer supplying container of FIG. 2 can be mounted on a developing device 8 of FIG. 3. In FIG. 3, the developing device 8 comprises a developer containing portion 9 for receiving the developer 12 dropped from the container 1 through the discharge opening 4, and a developing roller 10 for carrying the developer supplied from the developer containing portion 9 and for supplying the developer, at a developing station, to an electrostatic latent image formed on an image bearing member 11 such as an electrophotographic photosensitive member.

Further, the developer containing portion 9 has a guide portion 14 with which the flange portion 13 of the developer supplying container 1 can be slidingly engaged. The container 1 can be mounted on or dismounted from the developing device along the guide portions 14 by the operator. In a condition that the container 1 is mounted on the developing device 8, the container is held by the guide portions 14.

The developer containing portion 9 has a slit opening 15 through which the film 5 is pulled out. The above-mentioned elastic seal member 6 is disposed at the slit opening (film outlet portion) 15, so that, after film 5 has been pulled in the direction A and was completely removed from the container 1, the slit opening 15 is sealed or closed by the elastic seal member 6, thereby preventing the developer in the developer containing portion 9 from leaking through the slit opening and preventing any foreign matter from entering into the containing portion 9 through the slit opening 15.

Incidentally, in the illustrated embodiment, while the elastic seal member 6 was provided integrally with the developer supplying container 1, the elastic seal member 6 may be adhered to the developer containing portion 9, for example, at the slit opening 15 to separate the seal member from the container 1.

Figure 4:
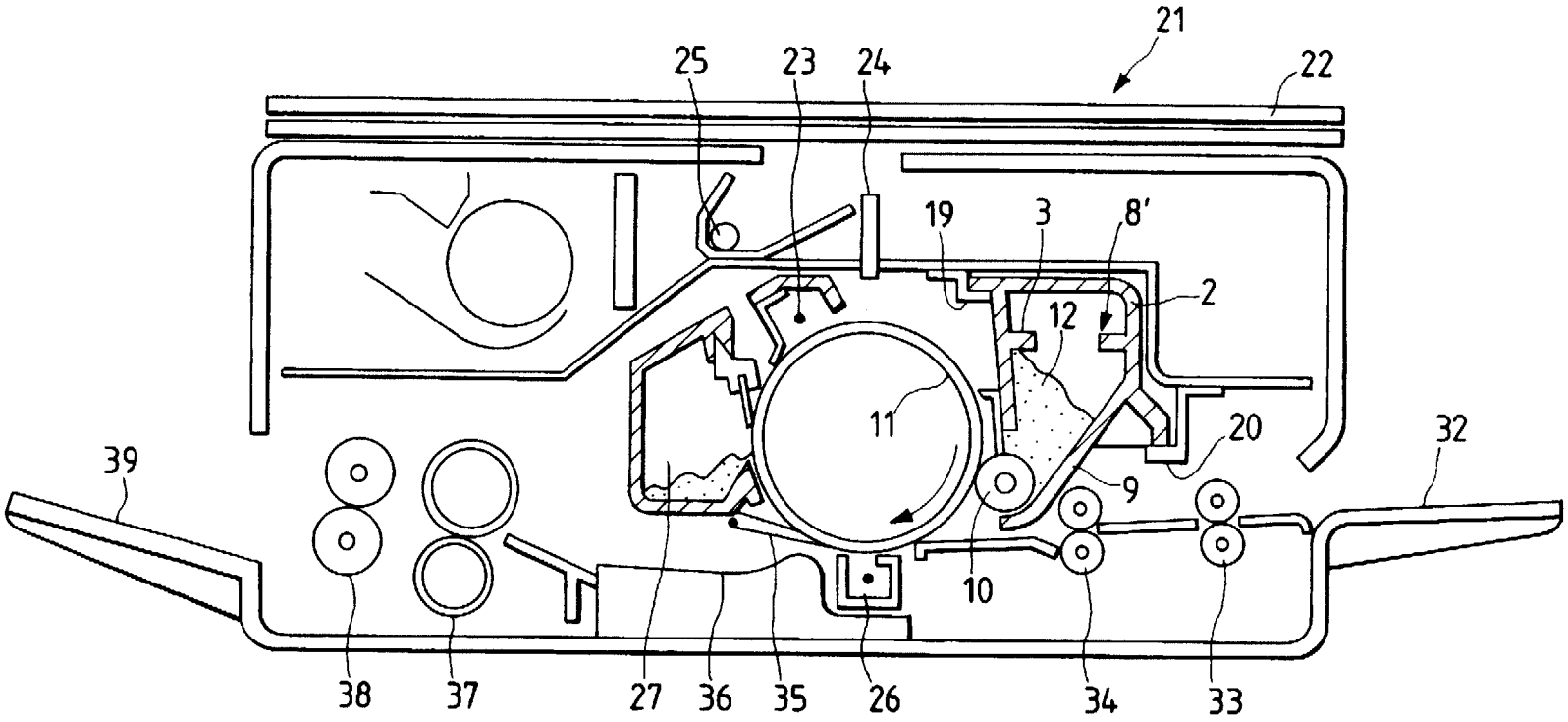
FIG. 4 is an elevational sectional view of an image forming apparatus within which the developing device can removably be mounted.

FIG. 4 shows an example of an electrophotographic image forming apparatus 21 with which the developing device according to the present invention can be used.

In the illustrated image forming apparatus 21, a photosensitive drum 11 comprising a conductive drum core and a photo-conductive layer (OPC member) disposed around the drum core is supported for rotational movement in a direction shown by the arrow. In the rotational direction of the drum 11, around the drum 11, there are arranged, in order, a corona discharger 23, a short focus optical element array 24, a developing device 8', a transfer corona discharger 26, and a cleaning device 27. In this image forming apparatus 21, the developing device 8' is supported and guided by guide rails 19, 20 formed on a frame of the image forming apparatus so that the developing device can be mounted within or dismounted from the apparatus by the operator. Within the apparatus, the developing device 8' is held by the guide rails 19, 20 at a developing station where a latent image formed on the photosensitive drum 11 is developed.

In the above image forming apparatus 21, a surface of the photosensitive drum 11 is uniformly charged with a predetermined electric polarity by the corona discharger 23, and then an original rested on an original support 22 reciprocally moving on the frame of the apparatus is illuminated by a lamp 25 so that light reflected from the original is focused on the drum 11 through the image focusing optical element array 24, thereby forming the latent image on the drum 11. The latent image so formed is developed by the developing device 8' with toner to form a toner image. The toner image is then transferred onto a transfer sheet by the transfer corona discharger 26. The transfer sheet is manually loaded on a transfer sheet supply tray 32 by the operator, and then is sent to a transfer station via convey rollers 33 and timing rollers 34. The transfer sheet to which the toner image was transferred is separated from the drum 11 by a separation means 35, and then is guided along a moving path 36 to reach a fixing device 37, where the toner image is permanently fixed to the transfer sheet. Then, the transfer sheet is discharged onto a sheet discharge tray 39 by discharge rollers 38.

Figure 5:
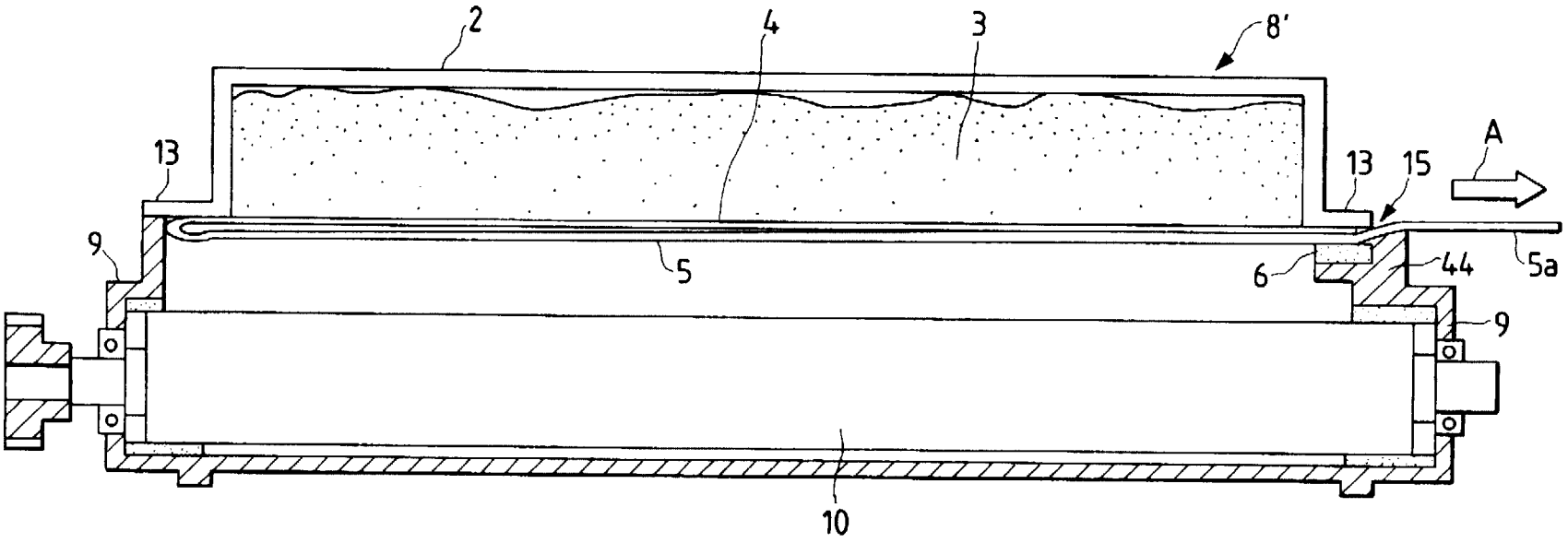
FIG. 5 is a sectional view of the developing device of FIG. 4.

As shown in FIG. 5 which is a longitudinal sectional view of the developing device 8', in this developing device 8', a lower flange portion 13 of a container body 2 of a developer supplying container is secured, by screws or adhesive, to a developer containing portion 9 of the developing device within which a developing roller 10 is disposed, so that the container body 2 and the containing portion 9 are integrally formed with each other. As in the aforementioned embodiment, a developer discharge opening 4 of the container body 2 is closed by a flexible film 5.

In this embodiment, the film 5 is pulled out in a longitudinal direction of the developing device as shown by the arrow A. An elastic seal member 6 similar to the aforementioned elastic seal member is disposed at a slit opening (film outlet portion) 15 and secured to the containing portion 9 to be engaged by a first surface of the film 5, so that, when the film 5 is being pulled out, the developer adhered to the first surface of a first portion of the film 5 is removed, and, after the film was completely pulled out, the slit opening 15 is closed by the seal member. The film 5 is removed from the developing device before the developing device 8' is mounted within an image forming apparatus 21 or after the developing device was mounted within the image forming apparatus or when the developing device is being inserted in the image forming apparatus.

When the developer in the developing device 8' is used up, the developing device is removed from the image forming apparatus 21, and a new developing device 8' is mounted within the apparatus.

Figure 6:
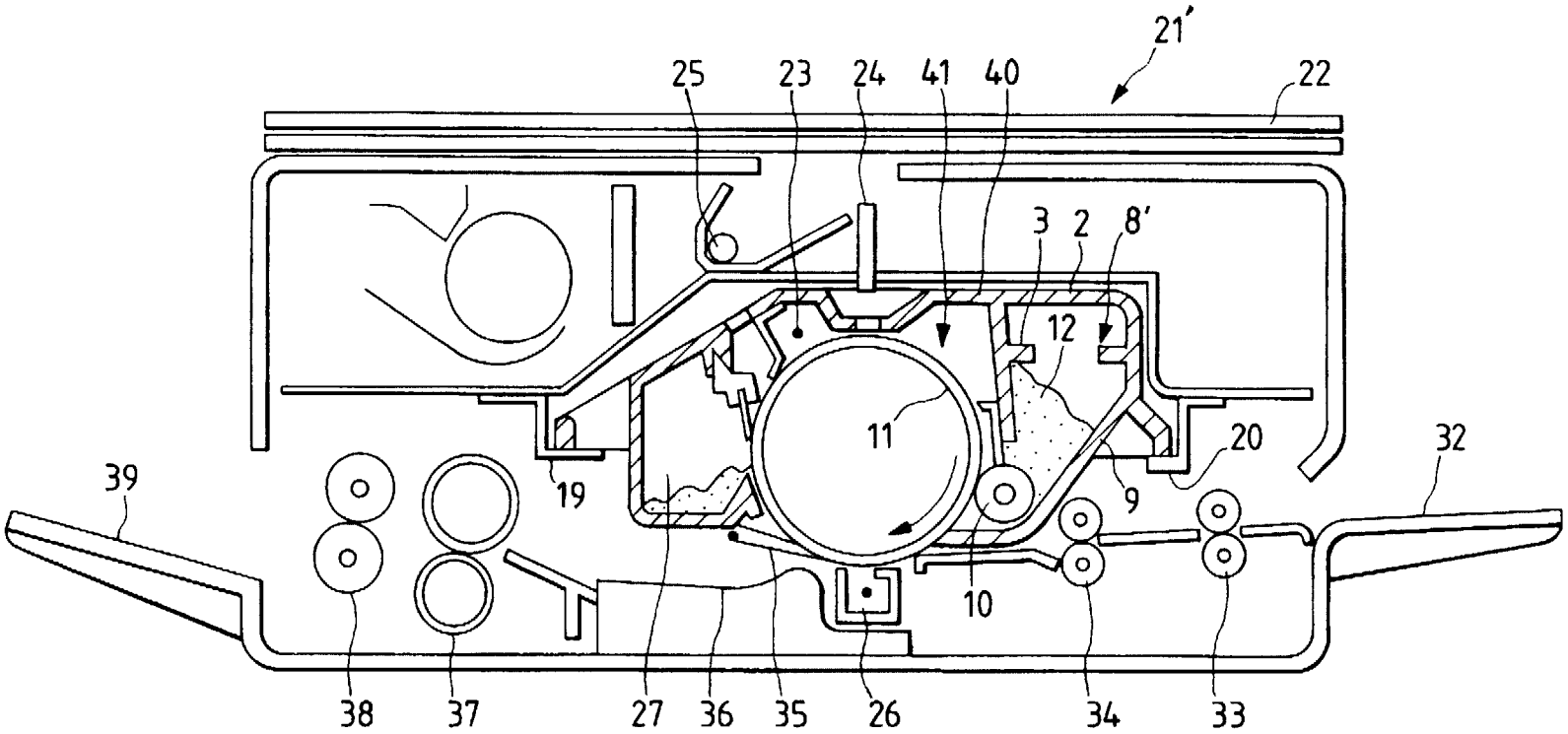
FIG. 6 is an elevational sectional view of an image forming apparatus within which a process cartridge can removably be mounted.

In FIG. 6, a process cartridge 41 having a frame 40 incorporating therein the developing device 8', photosensitive drum 11, charger 23 and cleaning device 27 as shown in FIGS. 4 and 5 is removably mounted within an image forming apparatus 21'. That is to say, when the developer 12 in the developing device 8' of the process cartridge is used up or consumed, the process cartridge is dismounted from the apparatus 21' and a new process cartridge 41 is mounted within the apparatus.

The process cartridge 41 is mounted within or dismounted from the image forming apparatus along guides 19, 20 by the operator, and is held at an image forming station in the apparatus by the guides 19, 20. The film 5 is removed from the developing device 8' to supply the developer 12 from the container body 2 to the containing portion 9, before the process cartridge 41 is mounted within the image forming apparatus 21' or after the process cartridge was mounted within the image forming apparatus or during the process cartridge is being inserted into the image forming apparatus.

While the process cartridge 41 shown in FIG. 6 has the charger 23 and the cleaning device 27, one or both of them may be omitted from the process cartridge 41.

The film outlet portion and therearound of the developing device according to each of the aforementioned embodiments is shown in FIG. 1 in detail.

In FIG. 1, a moving path for pulling the flexible film 5 comprises first, second, and third path portions $P_1$, $P_2$ and $P_3$. The first path portion $P_1$ is a path through which the film 5 reaches the elastic seal member 6, the second path portion $P_2$ is a path along which the first surface 51 of the film is slidingly contacted with the elastic seal member 6, and the third path portion $P_3$ is a path along which the film 5 is separated from the elastic seal member 6. That is to say, the first path portion $P_1$ is disposed at an upstream side of the elastic seal member 6 in a film pulling direction, and the third path portion $P_3$ is disposed at a downstream side of the elastic seal member 6 in the film pulling direction, and the first, second and third path portions $P_1$, $P_2$ and $P_3$ are contiguous to each other in order.

In FIG. 1, a film guide surface 43 is arranged at a downstream side of the elastic seal member 6 in the film pulling direction, i.e., in the third path portion $P_3$. The guide surface 43 is offset from an extension line 45 extending from the first path portion $P_1$ (along which the film 5 reaches the elastic seal member 6) toward a direction directing the first surface 51 of the film 5 which can be slidingly contacted with the elastic seal member 6 to a second surface 52 of the film opposed to the first surface 51. In FIG. 1, since the second surface 52 is positioned above the first surface 51, the guide surface 43 is also positioned above the extension line 45.

The guide surface 43 contacts with the first surface 51 of the film 5 so that the moving direction of the film 5 in the second path portion $P_2$, i.e., the moving direction of the film 5 passing through the elastic seal member 6 is regulated by the guide surface (Incidentally, as mentioned above, when the discharge opening 4 of the container body 2 is closed by the film 5, the first surface 51 of the first portion of the film 5 is contacted with the developer in the container body 2).

In the developing device shown in FIG. 5, the guide surface 43 is formed on a protruded portion 44 of the developer containing portion 9, as shown in FIG. 1, and, in the developer supplying container 1 shown in FIG. 2, the guide surface is formed on a protruded portion 44 integrally formed with the holder portion 7. In place of the guide surface formed on the protruded portion 44 of the holder portion 7 as shown in FIG. 2, a protruded portion having the guide surface 43 may be formed on the developer containing portion 9 of the developing device as shown in FIG. 3. The guide surface (film sliding surface) 43 is formed from a hard member made of hard plastic, metal or the like. In any way, the guide surface 43 is preferably formed as an arcuated surface for reducing the sliding resistance of the film 5 and for preventing the tearing of the film 5.

The flexible film 5 is bent upwardly away from the extension line 45 in the second path portion $P_2$ (at a corner 42 of the flange 13 of the container body 2 in FIG. 1) because of the presence of the protruded guide surface 43. In other words, in the second path portion $P_2$ where the film 5 is slidingly contacted with the elastic seal member 6, the film 5 is bent convexly toward the elastic seal member 6.

At the corner 42 of the flange, a bending angle a of the film 5 (i.e., an angle between a line 46 perpendicular to the extension line 45 and a moving path of the film 5 after bending) is greater than 0 degree, but smaller than 90 degrees (it the angle a is greater than 90 degrees, it means that the guide surface 43 does not, exist above the extension line 45; and, in this case, the inconvenience as mentioned above will occur).

In any way, even when the operator pulls the film 5 in any direction such as, direction A, B or C, since the moving direction of the film 5 on the elastic seal member 6 is regulated by the guide surface 43, it is possible to prevent the excessive load from acting on the elastic seal member 6, thereby preventing the damage of the seal member.

After film peeling tests regarding developer supplying containers or developing devices having the above-mentioned angle a of 30–45 degrees were effected, it was found that the peeling resistance was about 3–6 Kg and the elastic seal member was not damaged or torn at all. In the peeling tests, even when the films were pulled in the direction B or the direction C, any problem did not occur. Further, after the peeling of the film, it was found that all of the developer in the container body 2 was substantially dropped into the developer containing portion 9 and no developer leaked from the container and the containing portion. Further, a vibration test, a decompression test, a dropping test and a high temperature/humidity endurance test were effected as the environmental test and transportation test, regarding ten developer supplying containers for each test. As a result, it was found that there was no abnormity such as the leakage of developer in all of the tests.

Further, even when the peeling test, the environmental test, and the transportation test were effected regarding developer supplying containers having the above-mentioned angle a of 60–80 degrees, it was found that no abnormity was ascertained.

To the contrary, in a developer supplying container having no guide surface 43, there is no problem when the film 5 is pulled out in the direction A or C; however, if the film is pulled in the direction B, the elastic seal member 6 will be entrained with the film, resulting in the tearing of the elastic seal member. In fact, after the peeling test was effected regarding 100 developer supplying containers (having no guide surface) by pulling the film in the direction B, it was found that the elastic seal member 6 was torn in five containers. In this case, the peeling resistance or strength was greater such as 8–10 Kgf, and it was-found that, after the film was completely removed, the developer was leaked through the torn elastic seal member 6.

Incidentally, after the film is completely removed from the container, since the elastic seal member 6 is closely contacted with the flange 13 of the container body 2 by its own elastic restoration to seal the slit opening 15 thereby preventing the scattering of the developer, the tearing of the elastic seal member will make the sealing of the slit opening incomplete.

Further, in the illustrated embodiments, while an example that the film is peeled from the container to which the film is adhered was explained, a portion of the film may be torn longitudinally from the remaining portion of the film, as disclosed in the Japanese Patent Application Laid-open Nos. 59-13262 and 1-315779.

What is claimed is:

1. A developer container to be used for an electrophotographic image forming apparatus, comprising:

a container body including a container and having an opening through which the developer passes;

a flexible seal member for openably closing said opening of said container body, said flexible seal member being pulled to be drawn out from an outlet portion of said container body to thereby open said opening;

an elastic scraping member provided along a moving path of said flexible seal member for scraping said flexible seal member;

a guide member provided at a downstream side where said flexible seal member contacts with said elastic scraping member in the moving path of said flexible seal member in order to reduce a contact pressure between said flexible seal member and said elastic scraping member, said guide member guiding said flexible seal member toward one surface thereof opposite to another surface thereof where said flexible seal member contacts with said elastic scraping member; and a regulating member disposed adjacent said opening and substantially opposite said guide member relative to the moving path of said flexible seal member for regulating a direction of movement of said flexible seal member and for facilitating sealing of said outlet portion when said flexible seal member is removed, said regulating member contacting said one surface of said flexible seal member as said another surface of said flexible seal member is guided by said guide member.

2. A developer container according to claim 1, wherein said flexible seal member comprises a first film portion attached to said container body around said opening, and a second film portion folded on said first film portion and having a free end portion, whereby, when said opening is closed by said flexible seal member, a first surface of said first film portion is in contact with the developer in said container body.

3. A developer container according to claim 2, wherein said first film portion is peelably adhered to said container body around said opening.

4. A developer container according to claim 3, wherein said elastic scraping member is made from a sponge elastomer.

5. A developer container according to claim 2, wherein said elastic scraping member is made from a sponge elastomer.

6. A developer container according to claim 1, wherein said elastic scraping member is made from a sponge elastomer.

7. A developer container according to claim 1, wherein said flexible seal member initially closes said opening and has a first surface, a second surface opposed to said first surface, and one free end portion, said flexible seal member being adapted to be pulled out from the outlet portion to open said opening by pulling said free end portion.

8. A developer container according to claim 1, wherein a moving path of said flexible seal member comprises a first path portion disposed at an upstream side of said elastic scraping member, a second path portion contiguous to said first path portion and along which said first surface of said flexible seal member is in contact with said elastic scraping member, and a third path portion contiguous to said second path portion and disposed at a downstream side of said elastic scraping member.

9. A developer container according to claim 8, wherein said guide member comprises a film guide surface with which said first surface of said flexible seal member is contacted in said third path portion, said film guide surface being contacted with said flexible seal member at a position offset from an extension line of said first path portion toward a direction directing from said first surface of said flexible seal member to said second surface, thereby regulating a moving direction of said flexible seal member in said second path direction.

10. A developer container according to claim 1, wherein said elastic scraping member is made from a sponge elastomer.

11. A developer container according to claim 1, wherein said elastic scraping member is made from felt.

12. A developer container according to claim 1, wherein said flexible seal member is made from a synthetic resin.

13. A developing apparatus to be used for an electrophotographic image forming apparatus, comprising:

a movable developer carrying member for carrying a developer for developing a latent image formed on a photosensitive member to a developing station; and a developer container including (a) a container body having an opening through which the developer passes, (b) a flexible seal member for openably closing said opening of said container body, said flexible seal member being pulled to be drawn out from an outlet portion of said container body to thereby open said opening, (c) an elastic scraping member provided along a moving path of said flexible seal member for scraping said flexible seal member, (d) a guide member provided at a downstream side where said flexible seal member contacts with said elastic scraping member in the moving path of said flexible seal member in order to reduce a contact pressure between said flexible seal member and said elastic scraping member, said guide member guiding said flexible seal member toward one surface thereof opposite to another surface thereof where said flexible seal member contacts with said elastic scraping member, (e) and a regulating member disposed adjacent said opening and substantially opposite said guide member relative to the moving path of said flexible seal member for regulating a direction of movement of said flexible seal member and for facilitating sealing of said outlet portion when said flexible seal member is removed, said regulating member contacting said one surface of said flexible seal member as said another surface of said flexible seal member is guided by said guide member.

14. A developing device according to claim 13, wherein said flexible seal member comprises a first film portion attached to said container body around said opening, and a second film portion folded on said first film portion and having a free end portion, whereby, when said opening is closed by said flexible seal member, a first surface of said first film portion is in contact with the developer in said container body.

15. A developing device according to claim 14, wherein said first film portion is peelably adhered to said container body around said opening.

16. A developing device according to claim 15, wherein said elastic scraping member is made from sponge elastomer.

17. a developing device according to claim 14, wherein said elastic scraping member is made from a sponge elastomer.

18. A developing device according to claim 13, wherein said elastic scraping member is made from a sponge elastomer.

19. A developing apparatus according to claim 13, wherein said flexible seal member initially closes said opening and has a first surface, a second surface opposed to said first surface, and one free end portion, said flexible film member being adapted to be pulled out from an outlet portion to open said opening by pulling said free end portion.

20. A developing apparatus according to claim 13, wherein a moving path of said flexible seal member comprises a first path portion disposed at an upstream side of said elastic scraping member, a second path portion contiguous to said first path portion and along which said first surface of said flexible seal member is in contact with said elastic scraping member, and a third path portion contiguous to said second path portion and disposed at a downstream side of said elastic scraping member.

21. A developing apparatus according to claim 20, wherein said guide member comprises a film guide surface with which said first surface of said flexible seal member is contacted in said third path portion, said film guide surface being contacted with said flexible seal member at a position offset from an extension line of said first path portion toward a direction directing from said first surface of said flexible seal member to said second surface, thereby regulating a moving direction of said flexible seal member in said second path direction.

22. A developing apparatus according to claim 13, wherein said elastic scraping member is made from a sponge elastomer.

23. A developing apparatus according to claim 13, wherein said elastic scraping member is made from felt.

24. A developing apparatus according to claim 13, wherein said flexible seal member is made from a synthetic resin.

25. A process cartridge removably mountable onto an electrophotographic image forming apparatus, comprising:

a photosensitive member; and a developing apparatus including (a) a movable developer carrying member for carrying a developer to a developing station, and (b) a developer container including (i) a container having an opening through which the developer passes, (ii) a flexible seal member for openably closing said opening of said container body, said flexible seal member being pulled to be drawn out from an outlet portion of said container body to thereby open said opening, (iii) an elastic scraping member provided along a moving path of said flexible seal member for scraping said flexible seal member, (iv) a guide member provided at a downstream side where said flexible seal member contacts with said elastic scraping member in the moving path of said flexible seal member in order to reduce a contact pressure between said flexible seal member and said elastic scraping member, said guide member guiding said flexible seal member toward one surface thereof opposite to another surface thereof where said flexible seal member contacts with said elastic scraping member, and (v) a regulating member disposed adjacent said opening and substantially opposite said guide member relative to the moving path of said flexible seal member for regulating a direction of movement of said flexible seal member and for facilitating sealing of said outlet portion when said flexible seal member is removed, said regulating member contacting said one surface of said flexible seal member as said another surface of said flexible seal member is guided by said guide member.

26. A process cartridge according to claim 25, wherein said flexible seal member has a first film portion attached to said container body around said opening, and a second film portion folded on said first film portion and having a free end portion, whereby, when said opening is closed by said flexible seal member, a first surface of said first film portion is in contact with the developer in said second container.

27. A process cartridge according to claim 26, wherein said first film portion is peelably adhered to said container body around said opening.

28. A process cartridge according to claim 27, wherein said elastic scraping member is made from a sponge elastomer.

29. A process cartridge according to claim 26, wherein said elastic scraping member is made from a sponge elastomer.

30. A process cartridge according to claim 25, wherein said elastic scraping member is made from a sponge elastomer.

31. A process cartridge according to claim 25, wherein said flexible seal member initially closes said opening and has a first surface, a second surface opposed to said first surface, and one free end portion, said flexible film member being adapted to be pulled out from an outlet portion to open said opening by pulling said free end portion.

32. A process cartridge according to claim 25, wherein a moving path of said flexible seal member comprises a first path portion disposed at an upstream side of said elastic scraping member, a second path portion contiguous to said first path portion and along which said first surface of said flexible seal member is in contact with said elastic scraping member, and a third path portion contiguous to said second path portion and disposed at a downstream side of said elastic scraping member.

33. A process cartridge according to claim 32, wherein said guide member comprises a film guide surface with which said first surface of said flexible seal member is contacted in said third path portion, said film guide surface being contacted with said flexible seal member at a position offset from an extension line of said first path portion toward a direction directing from said first surface of said flexible seal member to said second surface, thereby regulating a moving direction of said flexible seal member in said second path direction.

34. A process cartridge according to claim 25, further comprising charger means for charging said photosensitive member.

35. A process cartridge according to claim 25, further comprising cleaner means for cleaning said photosensitive member.

36. A process cartridge according to claim 25, wherein said elastic scraping member is made from felt.

37. A process cartridge according to claim 25, wherein said flexible seal member is made from a synthetic resin.

38. An electrophotographic image forming apparatus onto which a process cartridge is removably mounted and forming an image on a recording medium, comprising:

mount means for removably mounting a process cartridge, said process cartridge comprising (1) a photosensitive member, and (2) a developing apparatus including (a) a movable developer carrying member for carrying a developer to a developing station, (b) a developer container including (i) a container body having an opening through which the developer passes, (ii) a flexible seal member for openably closing said opening of said container body, said flexible seal member being pulled to be drawn out from an outlet portion of said container body to thereby open said opening, (iii) an elastic scraping member provided along a moving path of said flexible seal member for scraping said flexible seal member, (iv) a guide member provided at a downstream side where said flexible seal member contacts with said elastic scraping member in the moving path of said flexible seal member in order to reduce a contact pressure between said flexible seal member and said elastic scraping member, said guide member guiding said flexible seal member toward one surface thereof opposite to another surface thereof where said flexible seal member contacts with said elastic scraping member, and (v) a regulating member disposed adjacent said opening and substantially opposite said guide member relative to the moving path of said flexible seal member for regulating a direction of movement of said flexible seal member and for facilitating sealing of said outlet portion when said flexible seal member is removed, said regulating member contacting said one surface of said flexible seal member as said another surface of said flexible seal member is guided by said guide member; and convey means for conveying the recording medium.

39. A method for assembling a process cartridge removably mounted onto an electrophotographic image forming apparatus, the process cartridge including a photosensitive member, a movable developer carrying member for carrying a developer to develop a latent image formed on the photosensitive member to a development station, a container body containing the developer and having an opening through which the developer is supplied to the developer carrying member, and an elastic scraping member, said assembling method comprising the steps of:

assembling a flexible seal member to the process cartridge to close the opening;

locating a guide member at a downstream side where the flexible seal member contacts with the elastic scraping member in a moving path of the flexible seal member in order to reduce a contact pressure between the flexible seal member and the elastic scraping member, so that the guide member guides the flexible seal member toward one surface thereof opposite to another surface thereof where the flexible seal member contacts with the elastic scraping member; and providing a regulating member disposed adjacent the opening and substantially opposite said guide member relative to the moving path of said flexible seal member for regulating a direction of movement of said flexible seal member and for facilitating sealing of said outlet portion when said flexible seal member is removed, said regulating member contacting said one surface of said flexible seal member as said another surface of said flexible seal member is guided by said guide member.

40. A developer supplying container to be used in an electrophotographic image forming apparatus for supplying developer to a developing device for developing an electrostatic latent image, comprising:

a container body containing the developer and having an opening through which the developer is supplied to said developing device;

a flexible seal member initially closing the opening and having a first surface, a second surface opposed to the first surface, and one free end portion, said flexible seal member being adapted to be pulled out from an outlet portion to open the opening by pulling the free end portion;

an elastic scraping member provided at the outlet portion and which the first surface of said flexible seal member slidingly contacts when being pulled out from said outlet portion;

a moving path of said flexible seal member comprising a first path portion disposed at an upstream side of said elastic scraping member, a second path portion contiguous with said first path portion and along which said first surface of said flexible seal member contacts said elastic scraping member, and a third path portion contiguous with said second path portion and disposed at a downstream side of said elastic scraping member;

a guide portion having a film guide surface which said first surface of said flexible seal member contacts in said third path portion, said film guide surface contacting said flexible seal member at a position offset from an extension of a line passing through said first path portion toward a direction from said first surface of said flexible seal member to said second surface, thereby regulating the direction of movement of said flexible seal member in said second path portion, so that the contact pressure of the first surface of said flexible seal member with said elastic scraping member is reduced; and a regulating portion disposed adjacent the opening and substantially opposite said film guide surface relative to the second path portion of said moving path for regulating a direction of movement of said flexible seal member and for facilitating sealing of said outlet portion when said flexible seal member is removed, said regulating portion contacting the second surface of said flexible seal member as the first surface is guided by said guide portion.

41. A developer supplying container according to claim 40, wherein said flexible seal member comprises a first film portion attached to said container body around the opening, and a second film portion folded on said first film portion and having a free end portion, whereby, when the opening is closed by said flexible seal member, a first surface of said first film portion contacts the developer in said container body.

42. A developer supplying container according to claim 41, wherein said first film portion is peelably adhered to said container body around the opening.

43. A developer supplying container according to claim 42, wherein said elastic scraping member is made from a sponge elastomer.

44. A developer supplying container according to claim 41, wherein said elastic scraping member is made from a sponge elastomer.

45. A developer supplying container according to claim 40, wherein said elastic scraping member is made from a sponge elastomer.

46. A developing device to be used in an electrophotographic image forming apparatus for developing an electrostatic latent image formed on a photosensitive member, comprising:

a movable developer carrying member for carrying developer to a developing station where the developer is applied to the electrostatic latent image;

a first container within which said movable developer carrying member is disposed;

a second container containing the developer therein;

an opening for shifting the developer from said second container to said first container;

a flexible seal member initially closing the opening and having a first surface, a second surface opposed to the first surface, and one free end portion, said flexible seal member being adapted to be pulled out from an outlet portion to open the opening by pulling the free end portion;

an elastic scraping member provided at said outlet portion and which slidingly contacts the first surface of said flexible seal member when said flexible seal member is pulled out from said outlet portion;

a moving path of said flexible seal member comprising a first path portion disposed at an upstream side of said elastic scraping member, a second path portion contiguous with said first path portion and along which said first surface of said flexible seal member contacts said elastic scraping member, and a third path portion contiguous with said second path portion and disposed at a downstream side of said elastic scraping member;

a guide portion having a film guide surface which said first surface of said flexible seal member contacts in said third path portion, said film guide surface contacting said flexible seal member at a position offset from an extension of a line passing through said first path portion toward a direction from said first surface of said flexible seal member to said second surface, thereby regulating the direction of movement of said flexible seal member in said second path portion, so that the contact pressure of the first surface of said flexible seal member with said elastic scraping member is reduced; and a regulating portion disposed adjacent the opening and substantially opposite said film guide surface relative to the second path portion of said moving path for regulating a direction of movement of said flexible seal member and for facilitating sealing of said outlet portion when said flexible seal member is removed, said regulating portion contacting the second surface of said flexible seal member as the first surface is guided by said guide portion.

47. A developing device according to claim 46, wherein said flexible seal member comprises a first film portion attached to said second container around the opening, and a second film portion folded on said first film portion and having said free end portion, whereby, when the opening is closed by said flexible seal member, a first surface of said first film portion contacts the developer in said second container.

48. A developing device according to claim 47, wherein said first film portion is peelably adhered to said second container around the opening.

49. A developing device according to claim 48, wherein said elastic scraping member is made from a sponge elastomer.

50. A developing device according to claim 47, wherein said elastic scraping member is made from a sponge elastomer.

51. A developing device according to claim 46, wherein said elastic scraping member is made from a sponge elastomer.

52. A process cartridge removably mounted onto an electrophotographic image forming apparatus, comprising:

a photosensitive drum;

a developing device for developing an electrostatic latent image formed on said photosensitive drum; and a frame removably engageable with a supporting portion of said electrophotographic image forming apparatus and within which said photosensitive drum and said developing device are disposed;

wherein said developing device comprises:

a movable developer carrying member for carrying developer to a developing station where the developer is applied to the electrostatic latent image;

a first container within which said movable developer carrying member is disposed;

a second container containing the developer;

an opening for shifting the developer from said second container to said first container;

a flexible seal member initially closing the opening and having a first surface, a second surface opposed to the first surface, and one free end portion, said flexible seal member being adapted to be pulled out from an outlet portion to open the opening by pulling said free end portion;

an elastic scraping member provided at said outlet portion and which slidingly contacts the first surface of said flexible seal member when said flexible seal member is pulled out from said outlet portion;

a moving path of said flexible seal member comprising a first path portion disposed at an upstream side of said elastic scraping member, a second path portion contiguous with said first path portion and along which said first surface of said flexible seal member contacts said elastic scraping member, and a third path portion contiguous with said second path portion and disposed at a downstream side of said elastic scraping member;

a guide portion having a film guide surface with which the first surface of said flexible seal member contacts in said third path portion, said film guide surface contacting said flexible seal at a position offset from an extension of a line passing through said first path portion toward a direction from the first surface of said flexible seal member to the second surface, thereby regulating the direction of movement of said flexible seal in said second path portion, so that the contact pressure of the first surface of said flexible seal member with said elastic scraping member is reduced; and a regulating portion disposed adjacent the opening and substantially opposite said film guide surface relative to the second path portion of said moving path for regulating a direction of movement of said flexible seal member and for facilitating sealing of said outlet portion when said flexible seal member is removed, said regulating portion contacting the second surface of said flexible seal member as the first surface is guided by said guide portion.

53. A process cartridge according to claim 52, wherein said flexible seal member has a first film portion attached to said second container around the opening, and a second film portion folded on the first film portion and having a free end portion, whereby, when the opening is closed by said flexible seal member, a first surface of said first film portion contacts the developer in said second container.

54. A process cartridge according to claim 53, wherein said first film portion is peelably adhered to said second container around said opening.

55. A process cartridge according to claim 54, wherein said elastic scraping member is made from a sponge elastomer.

56. A process cartridge according to claim 53, wherein said elastic scraping member is made from a sponge elastomer.

57. A process cartridge according to claim 52, wherein said elastic scraping member is made from a sponge elastomer.

58. A process cartridge having a frame and removably mountable onto an electrophotographic image forming apparatus, said process cartridge comprising:

a photosensitive drum disposed in said frame; and a developing device disposed adjacent to said photosensitive drum in said frame, said developing device having a movable developer carrying member; a first container within which said movable developer carrying member is disposed; a second container that is a developer-containing container; a rectangular opening formed in said second container in a longitudinal direction and disposed between said first container and said second container; a flexible seal member, a portion of which is removably fixed to said second container, disposed between said first container and said second container and initially closing said rectangular opening, said flexible seal member having a first surface, a second surface opposite said first surface, and a free end portion, and said flexible seal member being adapted to be pulled out from an outlet portion between said first container and said second container to open said rectangular opening by pulling said free end portion; an elastic scraping member provided on said first container and adjacent one longitudinal end of said rectangular opening, said elastic scraping member slidingly contacting said first surface of said flexible seal member when said flexible seal member is pulled out from said outlet portion; a moving path of said flexible seal member comprising a first path portion disposed at an upstream side of said elastic scraping member in a longitudinal direction along said rectangular opening, a second path portion contiguous with said first path portion and along which said first surface of said flexible seal member contacts said elastic scraping member, and a third path portion contiguous with said second path portion and disposed at a downstream side of said elastic scraping member; a guide portion, formed on said first container and having a film guide surface, which contacts said first surface of said flexible seal member in said third path portion when said flexible seal member is pulled from said outlet opening, said film guide surface contacting said first surface of said flexible seal member at a position offset, in a direction perpendicular to said plane and toward said second surface of said flexible seal member from said first surface of said flexible seal member at a position where said film guide surface contacts said first surface, from a plane containing said rectangular opening; and a regulating portion disposed adjacent said rectangular opening and substantially opposite said film guide surface relative to the moving path of said flexible seal member, formed on said second container, said regulating portion contacting said second surface of said flexible seal member when said flexible seal member is pulled from said outlet opening, and said regulating portion facilitating sealing of said outlet portion when said flexible seal member is removed.

* * * * *

UNITED STATES PATENT AND TRADEMARK OFFICE

CERTIFICATE OF CORRECTION

PATENT NO. : 5,778,282

DATED : July 7, 1998

INVENTOR(S) : TOSHIAKI NAGASHIMA

It is certified that error appears in the above-identified patent and that said Letters Patent is hereby corrected as shown below:

Title page:

[56] REFERENCES CITED

Foreign Patent Documents
"1315779" should read --1-315779--.

COLUMN 1

Line 62, "of-the" should read --of the--.

COLUMN 2

Line 10, "in an" should read --in a--.

COLUMN 3

Line 3, "adhered." should read --adhered--.

COLUMN 4

Line 62, "during" should read --when--.

COLUMN 5

Line 64, "(it" should read --(if--.
Line 65, "not." should read --not--.

COLUMN 6

Line 39, "was-found" should read --was found--.

UNITED STATES PATENT AND TRADEMARK OFFICE

CERTIFICATE OF CORRECTION

PATENT NO. : 5,778,282

DATED : July 7, 1998

INVENTOR(S) : TOSHIAKI NAGASHIMA

It is certified that error appears in the above-identified patent and that said Letters Patent is hereby corrected as shown below:

COLUMN 8

Line 37, "device" should read --apparatus--.
Line 45, "device" should read --apparatus--.
Line 48, "device" should read --apparatus--.
Line 49, "sponge" should read --a sponge--.
Line 51, "a" should read --A--; and "device" should read --apparatus--.
Line 54, "device" should read --apparatus--.

Signed and Sealed this

Fourth Day of May, 1999

*Attest:*

Q. TODD DICKINSON

*Attesting Officer*

*Acting Commissioner of Patents and Trademarks*